US005449075A

United States Patent [19]

Meade et al.

[11] Patent Number: 5,449,075

[45] Date of Patent: Sep. 12, 1995

[54] IMPROVEMENTS IN AND RELATING TO A FOLDABLE CLOTHES LINE

[75] Inventors: Ronald G. Meade; John S. Brown, both of Edwardstown, Australia

[73] Assignee: Hills Industries Limited, Edwardstown, Australia

[21] Appl. No.: 247,040

[22] Filed: May 20, 1994

[30] Foreign Application Priority Data

May 20, 1993 [AU] Australia ..... PL8907

[51] Int. Cl.[6] ..... A47B 43/00

[52] U.S. Cl. ..... 211/197; 211/167

[58] Field of Search ..... 211/197, 196, 205, 119.03, 211/119.01, 167; 343/880, 881, 915

[56] References Cited

U.S. PATENT DOCUMENTS

| | | | |
|---|---|---|---|
| 2,802,579 | 8/1957 | Hagar | 211/167 |
| 4,550,840 | 11/1985 | Van Deursen | 211/197 |
| 4,610,364 | 9/1986 | Meade | 211/197 |
| 4,724,969 | 2/1988 | Steiner | 211/197 |

FOREIGN PATENT DOCUMENTS

| | | |
|---|---|---|
| 258869 | 1/1965 | Australia . |
| 458172 | 9/1973 | Australia . |

*Primary Examiner*—Leslie A. Braun
*Assistant Examiner*—Anita M. King
*Attorney, Agent, or Firm*—Darby & Darby

[57] ABSTRACT

A foldable clothes line comprises a series of arms (12) which radiate outwardly from a lower cross (13) fixed to a central standard (11), the arms (12) being guided by stays (14) pivotally connected at their outer ends to the arms (12) and at their inner ends to an upper cross (16) mounted at the upper end of the standard (11), wherein each of the arms (12) comprises relative rotatable inner and outer arms portions (18, 19) which are hingedly connected by a hinge mechanism (20) so as to permit relative pivotal movement of the arm portions about a transverse axis, releasable locking mechanism (28) being provided for preventing relative pivotal movement of the arm portions (18, 19) when the arm (12) is in a fully extended position, arranged so that each of the arms (12) is independently movable between a collapsed condition wherein its inner and outer arm portions (18, 19) lie alongside one another and extend approximately vertically adjacent the standard (11) and a fully extended in-use position wherein the arm extends approximately radially outwards from the standard (11).

16 Claims, 7 Drawing Sheets

IMPROVEMENTS IN AND RELATING TO A FOLDABLE CLOTHES LINE

This invention relates to improvements to a foldable clothes of the type wherein a series of arms radiate outwardly form a lower cross or boss located on a central standard, the arms being guided by stays pivoted at their upper ends to an upper cross supported at the upper end of the standard and at their lower ends to respective said arms intermediate the ends thereof, with the arms being movable between a collapsed condition wherein they lie in proximity to the standard approximately parallel therewith and an extended in-use position where they extend approximately radially outwards from the standard.

BACKGROUND OF THE INVENTION

Foldable clothes drying devices of this general type have been known for many years and are in common use. Generally, these have been limited to an arrangement wherein the lower cross or boss to which each of the radiating line support arms is pivotally attached, is slidable along the standard, with each of the arms being formed from a single length of rigid steel tube. When the arms are folded outwardly, their inner ends move upwardly along the standard together with the slidable lower cross, whilst when folded inwardly, their inner ends, along with the lower cross, move downwardly along the standard. When in the fully collapsed position, the elongate arms extend approximately vertically and project well above the upper end of the standard. While clothes lines or hoists of the aforementioned type have been found to be generally satisfactory and popular with consumers, they are not without their drawbacks. For example the step of folding the elongate support arms between their extended in-use and collapsed or retracted positions can prove awkward for some people, especially those of small stature, bearing in mind that all (generally four) of the arms fold simultaneously. Such an operation involves the releasing of a latch mechanism carried on the lower cross in order to release same to allow it to move along the standard.

Another drawback is the tendency of the clothes lines which extend between the elongate arms to become entangled when the hoist is in its collapsed position. Such entanglement often interferes with the folding movement of the arms from their retracted to their extended positions.

A still further drawback with existing collapsible clothes hoists is their relatively large overall height when in the collapsed condition, it being appreciated that the arms when collapsed extend well beyond the upper end of the standard. From an aesthetic point of view, this can detract from the overall appearance of the product.

SUMMARY OF THE INVENTION

It is an object of the present invention to provide improvements which will obviate at least some of the aforementioned drawbacks, in particular improvements which will allow the clothes hoist to be far more easily extended and retracted in comparison to known hoists.

It is a further object of the present invention to provide an improved clothes hoist wherein the likelihood of the flexible clothes lines becoming entangled when the hoist is in a collapsed condition, is less likely to occur.

It is yet a further object of the present invention to provide an improved collapsible clothes hoist which is of extremely simple design, less expensive and far more pleasing aesthetically particularly in its non-operative collapsed position.

Broadly according to this invention therefore, each of the arms of a clothes line of the type as defined hereinbefore, comprises relative rotatable inner and outer arm portions, said inner arm portion having its inner end pivotally attached to said lower cross or boss on the standard, hinge means pivotally interconnecting adjacent ends of said inner and outer arms portions for permitting relative pivotal movement of the arm portions about an axis transverse to the arm, and releasable locking means for preventing said relative pivotal movement of the arm portions when the arm is in its extended position, said arm when in its collapsed position having its inner and outer arm portions lying alongside one another and extending approximately vertically adjacent the standard.

With this arrangement, each of the arms can be retracted and extended independently of the other arms which greatly simplifies the collapsing and unfolding procedures. By having each of the arms comprised of two hinged arm sections, the overall height of the hoist when collapsed, can be significantly reduced. Still further, it avoids the need to utilize a sliding lower cross or boss which can be simply fixed to the standard.

Preferably each of the stays has its outer or lower end pivotally connected to pivot means carried by a connector bracket attached to the outer arm portion of a respective said arm, said connector bracket being located near to the hinge connection between the two arm portions, arranged and constructed so that when each of the arms is in a collapsed condition the stay is located between the inner and outer arm portions in co-planar relationship therewith.

Preferably the inner arm portion of each said arm is pivotally connected at its inner end to pivot means carried on the lower cross, wherein the axis of said pivot means extends approximately radially with respect to the axis of the standard. With this arrangement, each of the inner arm portions lies approximately tangentially of the tubular standard.

In order to minimize bending moments being applied to the arms when loaded with wet clothes, it is desirable that the outer arm portions of the diametrically opposed arms be collinear. Due to the tangential disposition of the inner arm portions, each outer arm portion (when fully extended), has its axis which is non longitudinally aligned with its associated inner arm portion. The offset between the arm portions of each arm is designed so that, when the arm is fully extended, the axis of the outer arm portion intersects the central axis of the standard and lies truly radial therewith.

Preferably the hinge means comprises a pair of interengaging relative rotatable parts which are essentially of the same shape but of opposite hand, each part comprising a cup-like disc shaped housing half having a central bore extending therethrough for receiving a pivot member which defines the transverse axis about which the inner and outer arm portions rotate relative to one another, said axis being offset with respect to the central longitudinal axis of each of the arm portions.

Preferably, each cup-shaped disc housing has a small angle offset with respect to a radial line extending from the standard, so as to enable the outer arm portion of each arm when extended, to extend radially of the standard and lie collinear with the outer arm portion of its opposite arm.

Preferably the locking means comprises a locking slide slidably housed between the two mating housing halves and being linearly slidable between a first normal locked position wherein the two halves are locked against relative rotation with the inner and outer arm portions approximately longitudinally aligned and a retracted unlocked position which allows the inner and outer arm portions to rotate relative to one another in order to collapse the arm assembly to lie alongside the standard.

Preferably each of the housing halves comprises an approximately tangentially disposed connector portion for securement to an end portion of a respective said arm portion.

Preferably, the inner arm portion of each arm is provided with clip means for clipping engagement with an associated stay when the arm is fully collapsed. This ensures that each arm is firmly retained when fully collapsed and will not pivot outwards until the stay is disengaged from its clip.

Preferably the standard of the clothes hoist comprises a fixed lower tubular standard, an upper tubular elevating standard telescopically engageable with the lower standard, and elevating means for raising the upper standard with respect to the lower standard, said elevating means comprising an operating handle projecting from one side of the fixed lower standard, and wherein said lower cross member is fast with the upper tubular elevating standard and is raised and lowered therewith.

BRIEF DESCRIPTION OF THE DRAWINGS

In order to more fully appreciate the present invention, a preferred embodiment thereof is described hereunder in some further detail with reference to and as illustrated in the accompanying drawings wherein.

Figure 9:
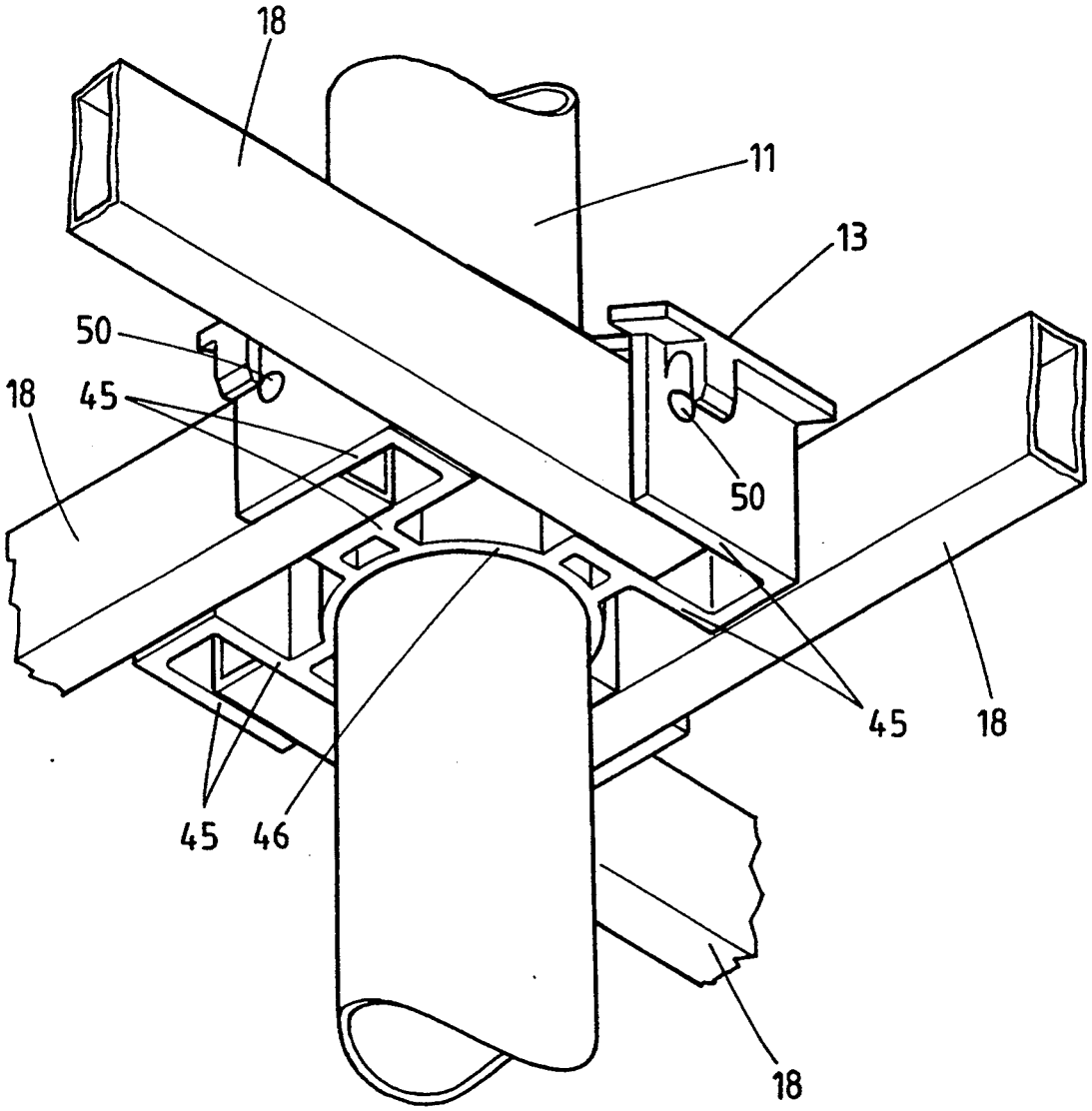

FIGS. *7a* and *7b* are top and underside perspective views respectively of the lower cross attached to the standard and to which the inner ends of the arms are pivotally attached;

FIGS. *8a* and *8b* are top and underside perspective views respectively of the upper cross which is fixed at the top of the standard and to which the inner ends of the stays are pivotally connected; and FIG. 9 is a fragmentary perspective view of the clothes hoist showing the configuration of the four support arms having their inner ends attached to the lower cross, when in their extended positions.

DETAILED DESCRIPTION OF THE INVENTION

According to this embodiment, a collapsible or foldable clothes line 10 comprises a standard 11 a plurality of, in this embodiment four, clothes line support arms 12, each of which has its inner end pivotally attached to a lower cross or boss 13, and a plurality of suspension stays 14 each of which has its outer end pivotally connected to a bracket connector 15 carried on a respective arm 12 intermediate the ends thereof and its inner upper end pivotally attached to an upper cross or boss 16 which is fixedly supported at the upper end of the standard 11. Flexible clothes lines 17 extend between the arms 12 in a conventional manner.

Figure 3:
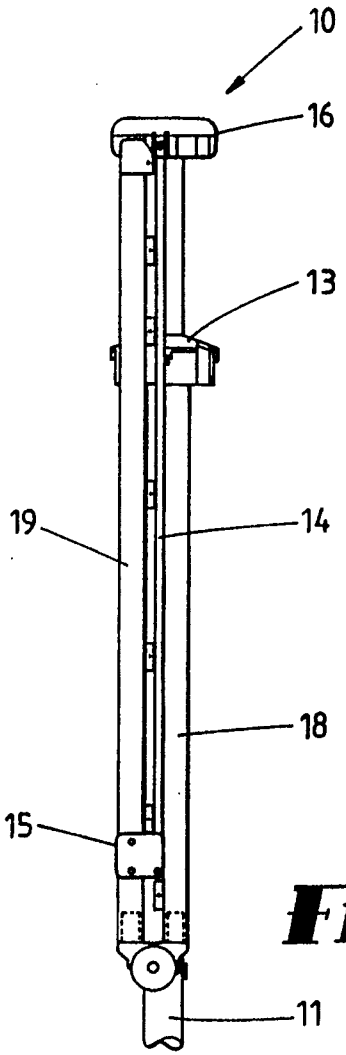
FIG. 3 is a side elevational view of the support arm assembly of FIG. 2 shown in its fully collapsed position.

In accordance with a feature of the present invention, each of the support arms 12 comprises inner and outer arm portions 18, 19 respectively pivotally interconnected by means of a hinge mechanism 20 which permits the arm portions 18, 19 to rotate relative to one another about an horizontal transverse axis 21 which, when the arm 12 is fully extended, lies above the upper surface of the arm 12. The arrangement of each arm and stay assembly is designed to permit each arm 12 to be either extended or collapsed independently of each of the other arms 12, each arm 12 when in the fully collapsed position (refer FIG. 3) having its arm portions 18, 19 together with the associated stay 14 extending approximately vertically immediately alongside the standard 11 and in approximately co-planar relationship. By constructing each of the arms 12 as two hinged sections, when the arm is in the collapsed condition, the distal end thereof need not project beyond the upper end of the standard 11 and hence provides a far more compact assembly in comparison to prior art foldable hoists.

The hinge mechanism 20 should be of robust construction and have sufficient strength to withstand loading forces applied to the arms 12 when the hoist is laden with clothes. In addition, when each arm is in its extended in-use position it is necessary to ensure that the arm portions 18, 19 are locked against relative rotational movement—as a safeguard against the arms inadvertently collapsing under the load of the clothes suspended thereby.

Figure 6:
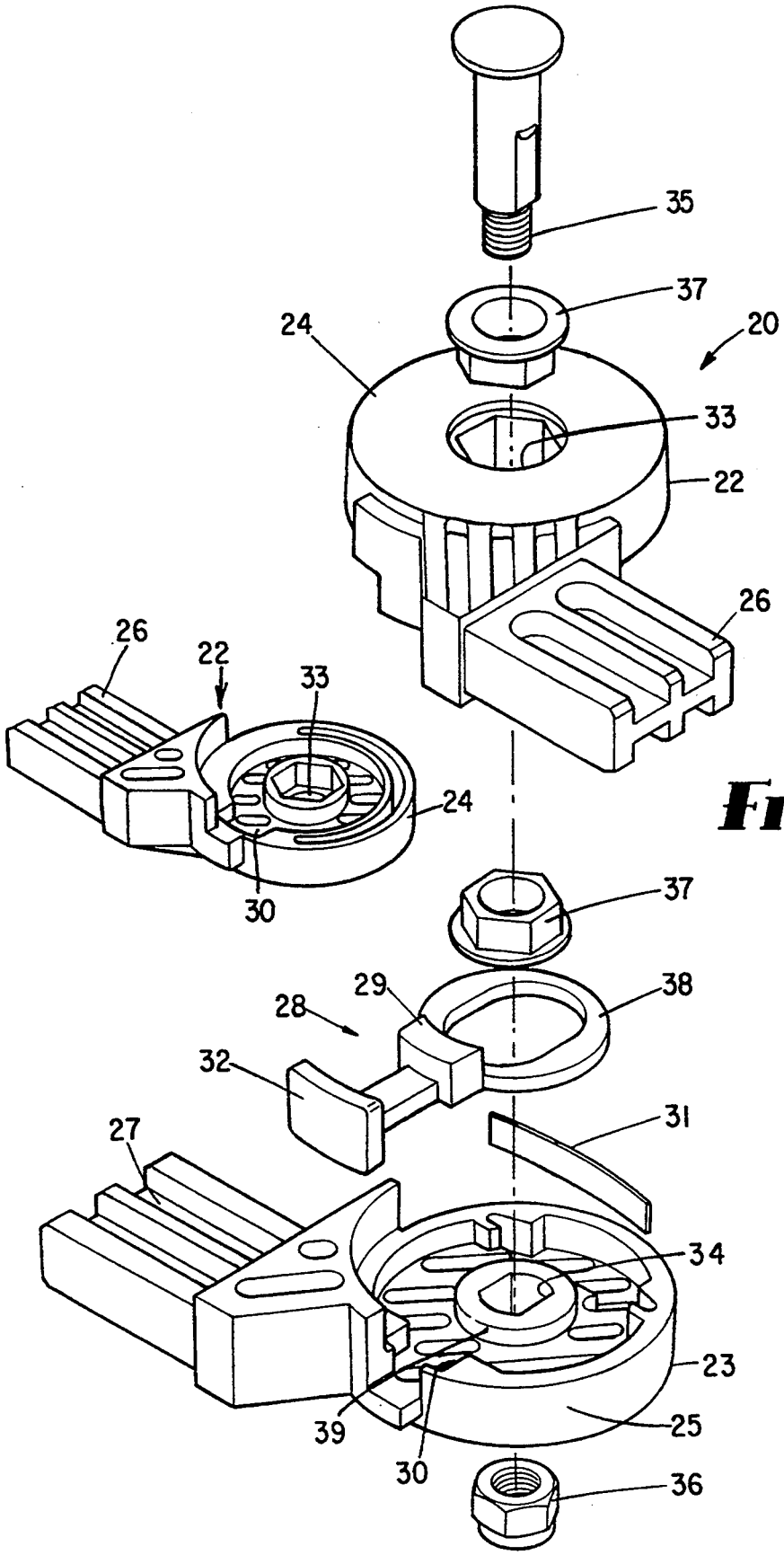
FIG. 6 is an exploded perspective view of the hinge mechanism which interconnects the inner and outer arm portions of each arm assembly.
Figure 7A:
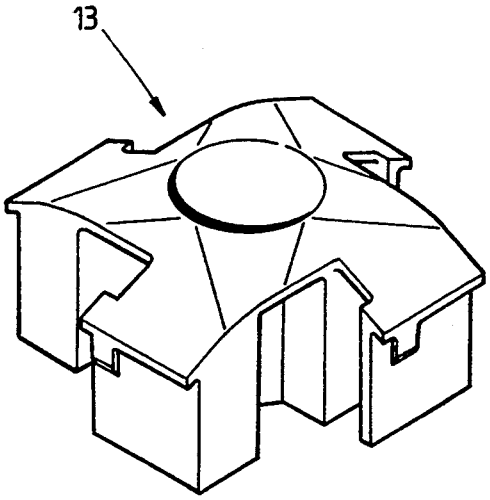
Figure 7B:
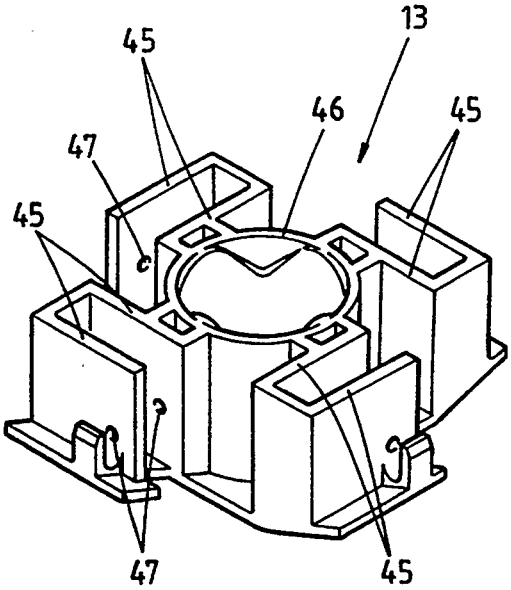
Figure 8A:
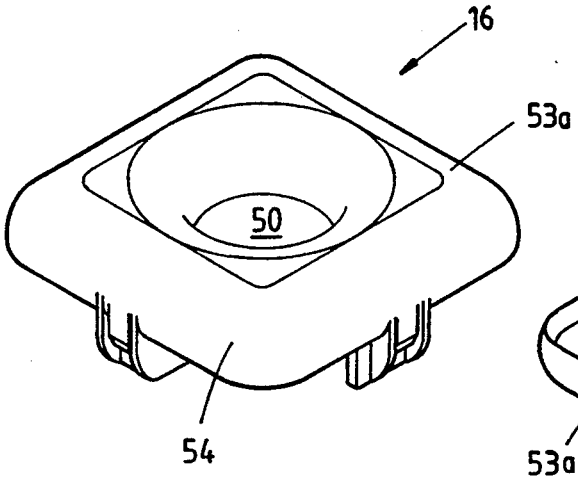
Figure 8B:
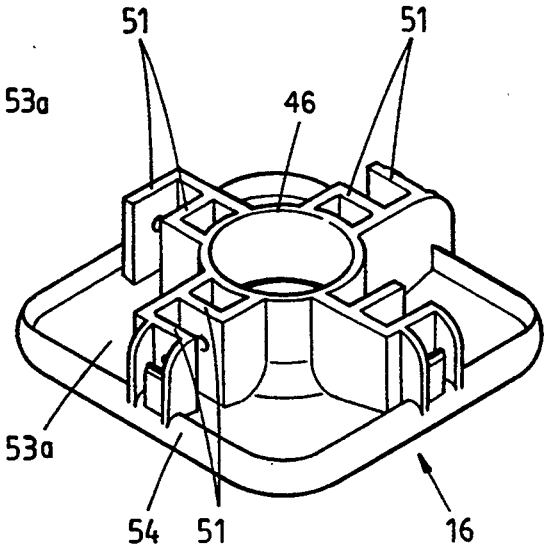

Referring to FIG. 6 of the drawings, the hinging mechanism 20 comprises a housing formed by a pair of relative rotatable interengaging parts 22, 23 which have essentially the same shape but of opposite hand. Each of the parts 22, 23 is formed of metal and comprises a circular cup-shaped housing half 24, 25 respectively to which is integrally formed a substantially tangentially disposed lug or Spigot portion 26, 27 which is inserted within and rigidly secured to an end portion of the inner and outer arm portions 18, 19 respectively. With the arm portions 18, 19 in their fully extended positions, the lug portions 26, 27 of the parts 22, 23 are slightly angled to one another. In this embodiment, there is a 2° offset for each housing half 24, 25, the purpose of which will be explained hereinafter.

The hinge mechanism 20 is provided with a locking slide 28 housed radially between the halves 24, 25 and being linearly slidable between a retracted unlocked position wherein its locking lug 29 lies clear of a locking recess 30 in each of the housings 23, 25 and which permits the two parts 22, 23 to rotate relative to one another and a normal extended locked position wherein the lug 29 is moved radially outwards under the influence of leaf spring 31, to a position wherein it is housed in the recesses 30 and locks the parts 22, 23 against relative rotation. When the arm 12 is folded outwardly to its fully extended position, the locking slide 28 is automatically locked in position by means of the leaf spring 31 held captive within housing 25. To disengage the locking mechanism, an operator applies finger pressure to an actuator member 32 on the locking slide 28 so as to press same inwardly and thereby slide the member 28 radially inwards, against the bias of the spring 31, to its unlocked position which allows the arm portions 18, 19 to rotate relative to one another.

As shown in FIG. 6, the two halves 24, 25 have central openings 33, 34 which align with one another and form a central pivot bolt receiving passageway for locating a central stepped pivot bolt 35 to which is threadably attached a clamp nut 36 for clamping the two halves 24, 25 together. In this embodiment, the pivot bolt 35 passes through two bearing sleeves 37 housed in opposite ends of opening 33 in the housing 24.

Figure 5:
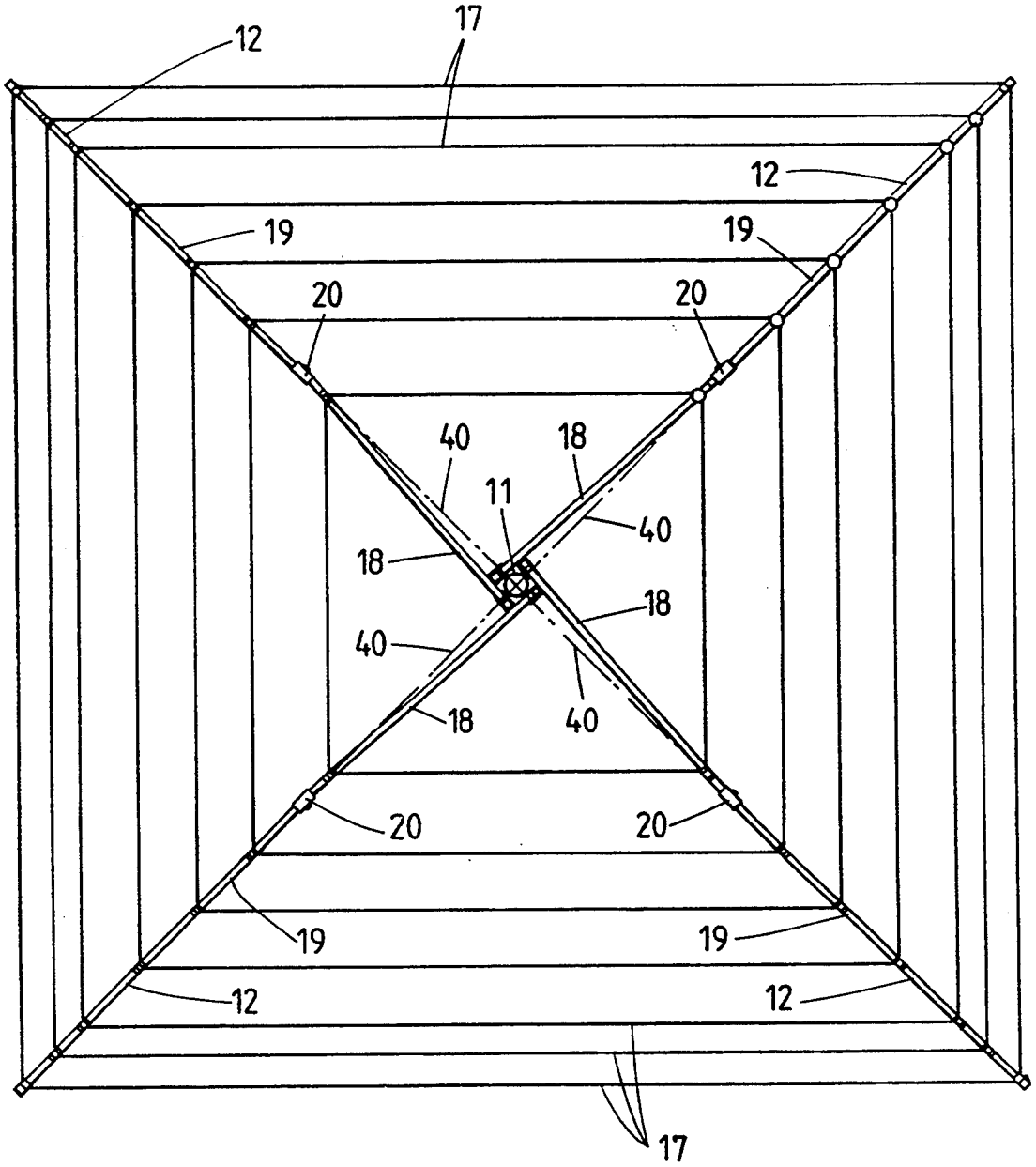
FIG. 5 is a plan view of the clothes line with the arms fully extended.

The locking slide 28 is provided with a loop portion 38 which joins to the locking lug 29, the loop portion 38 being positionable around central boss 39 on housing 25 and having an inner periphery which is oval-shaped. The slide 28 is thus guided for linear radial movement with respect to the pivot axis of the hinge mechanism 20. When in its retracted unlocked position, the leaf spring 31 is in a deformed state with the tail portion of the loop 38 abutting thereagainst, the deformed spring 31 being arranged to return the locking slide 28 to its extended locked position upon the arm portions 18, 19 assuming their extended operative longitudinally aligned positions. This acts as a safety feature in that each of the arms 12 automatically locks into its fully extended position and no relative pivotal movement of the arm portions 18, 19 can occur until the locking mechanism 20 is manually unlocked. Referring to FIG. 5 of the drawings, each arm 12 has its outer arm portion 19, when fully extended, disposed radially to the standard 11, and its inner arm portion 8 disposed approximately tangentially to the standard 11 and being inclined at a small angle, eg 4°, to the central longitudinal axis 40 of the outer arm portion 19. This arrangement minimizes bending moments applied to the arms 12, when loaded with clothes, and ensures that the arms 12 do not rotate in radial planes.

Referring to FIGS. *7a*, *7b* of the drawings, the lower cross or boss 13 is provided with four pairs of spaced lugs 45 spaced circumferentially around a central cylindrical sleeve 46, the four pairs of lugs 45 containing respective inner pivot pins 50 which support the inner ends of the four radiating line support arms 12. The pivot pins 50 locate in respective pairs of aligned holes 47 formed in the lugs 45. In contra-distinction to prior art constructions, the pairs of lugs 45 are disposed approximately tangentially to the circumference of the sleeve 46 and also to the circumference of the standard 11. As shown in FIG. 9, the inner end of each line support arm 12, when in its extended operative position, is tangentially disposed with respect to the standard 11 (rather than radially with prior art arrangements). This provides a far more compact arrangement when the hoist is in a collapsed condition, with each of the collapsed arms 12 being able to lie flat in close proximity to the periphery of the standard 11.

Referring to *8a* and *8b* of the drawings, the upper cross 16 which, like the lower cross 13, is integrally moulded of plastics material, is provided with a central cylindrical sleeve or skirt 50 which snugly slidably locates over the top end of the standard 11, and four pairs of tangentially disposed lugs 51 spaced around the circumference of the sleeve 50, the four pairs of lugs 51 containing respective pivot pins which support the inner ends of the four stays 14 which support the arms 12. The upper cross 16 is also formed with a rectangular horizontal upper wall 53*a* which is provided with a depending peripheral flange 54, with each of the pairs of lugs 51 being located between the central sleeve 50 and the peripheral flange 54.

In this embodiment, the hoist 10 has an elevating mechanism 52 (refer FIG. 1) whereby it can be raised and lowered in a known manner. The elevating mechanism 52 does not form part of this invention and is not illustrated, apart from winding handle 53. In the situation where elevating mechanism 52 is employed, the standard 11 comprises a fixed tubular lower standard 11' and a rotatable tubular upper standard 11" which is an elevating standard and is telescopically movable within the upper open end of the lower standard 11'. With the upper standard 11" in a raised position, the head of the hoist 10 may rotate about the axis of the fixed lower standard, which again is known art.

Figure 1:
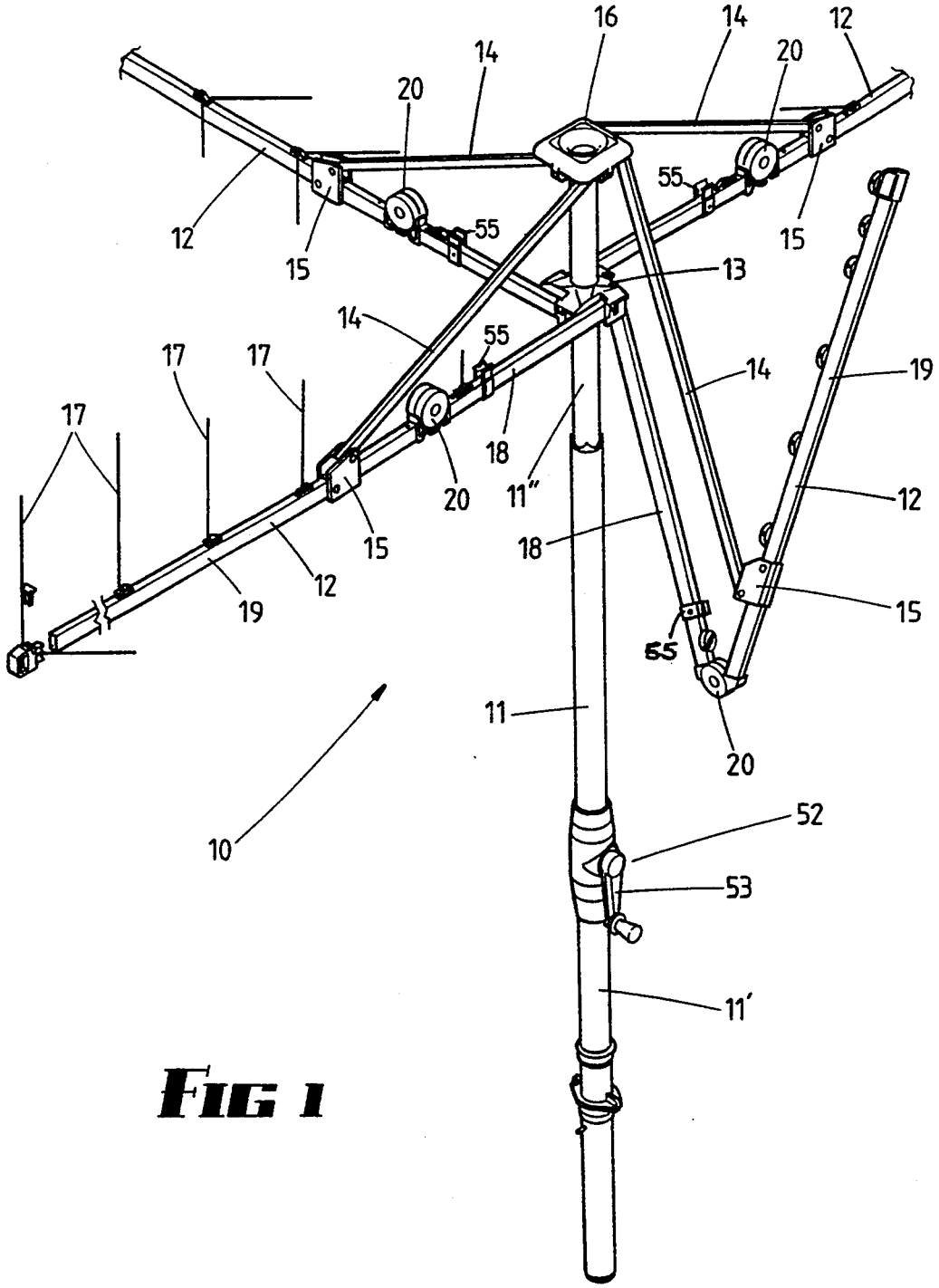
FIG. 1 is a perspective view of a folding clothes line incorporating the inventive features of the present invention, and showing three of the arms fully extended and the remaining arm partly collapsed.
Figure 2:
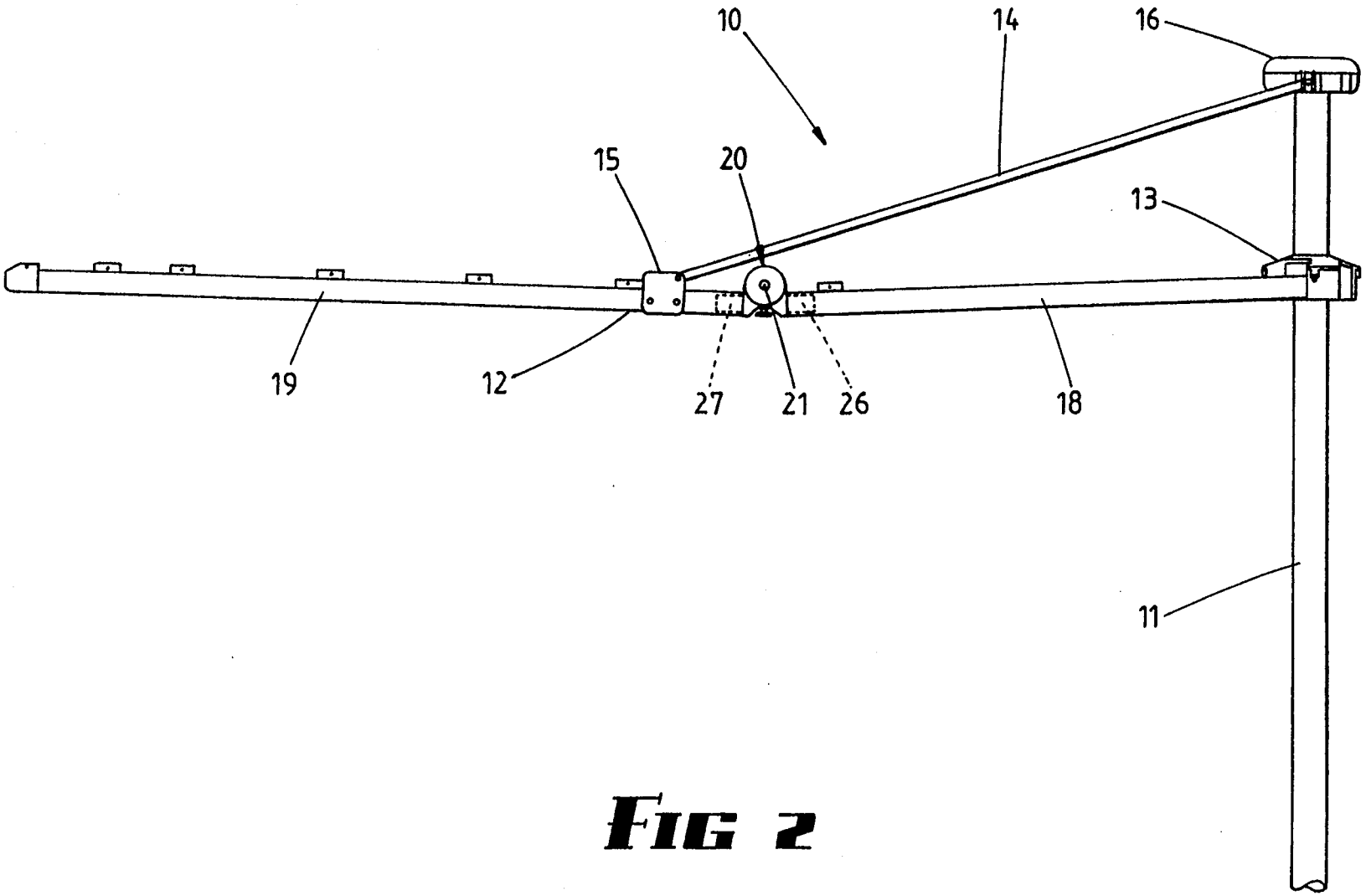
FIG. 2 is a side elevational view of one of the support arms (shown in an extended position) of the foldable clothes line shown in FIG. 1.
Figure 4:
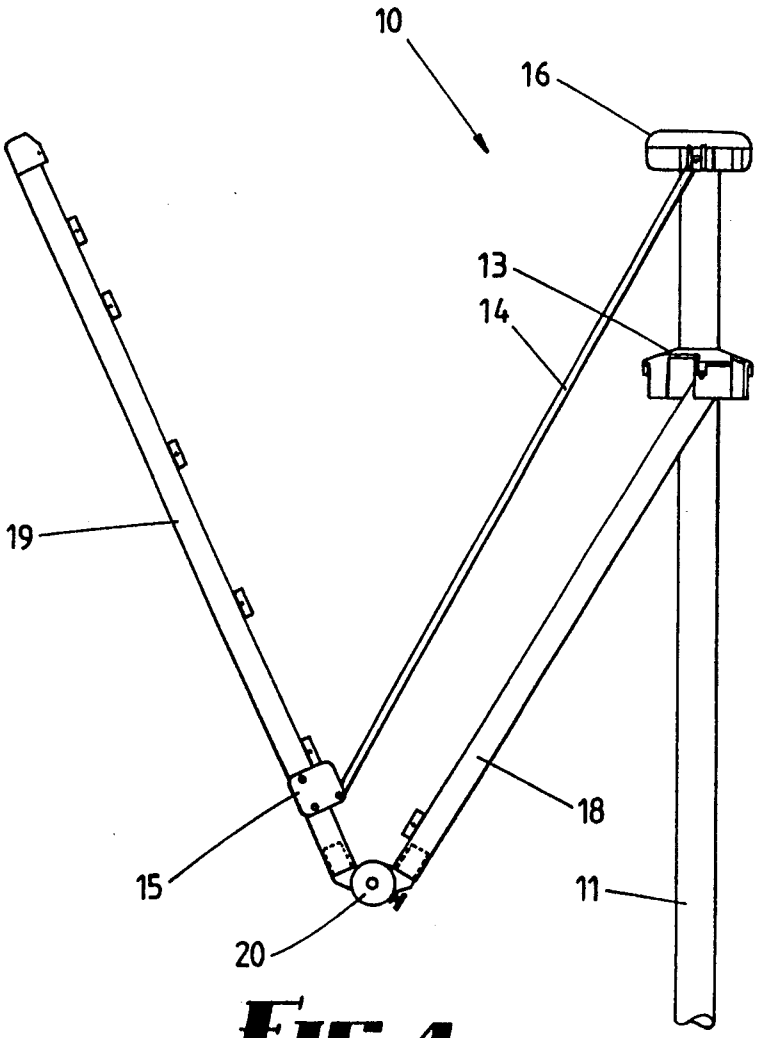
FIG. 4 is a side elevational view of the support arm assembly of FIG. 2 shown in a partly collapsed position.

As also shown in FIG. 1, each inner arm portion 18 of each arm has attached, near its hinged end a U-shaped clip 55 which can be moulded of a suitable plastics material. The clip 55 is designed to straddle the arm and has its resilient opposite legs extending upwardly beyond the upper edge of the arm 12 so as to form a slot for clippingly retaining an associated stay 14 when the arm 12 is fully collapsed. The clips 55 ensure that the arms 12 can be firmly retained in their collapsed positions alongside the standard 11.

A brief consideration of the above described embodiment will indicate that the invention provides for improvements to a collapsible clothes hoist which allow it to be far more easily collapsed and extended with less likelihood of the clothes support lines becoming entangled with one another, and one which has improved aesthetic appearance.

We claim:

1. A foldable clothes line having a series of arms radiating outwardly from a lower cross or boss located on a central standard, said arms being supported by stays which are pivoted at their upper ends to an upper cross or boss mounted on the upper end of said standard and at their lower ends to respective said arms intermediate the ends thereof, said arms being movable between a collapsed condition wherein said arms extend approximately upright in proximity to the standard and an extended in-use position wherein said arms extend outwards from the standard, the improvements wherein:

each said arm comprises interconnected inner and outer arm portions, said inner arm portion having its inner end pivotally attached to said lower cross or boss, a hinge means pivotally interconnecting adjacent ends of said inner and outer arm portions for permitting relative pivotal movement of the arm portions about an axis transverse to the arm, and said releasable locking means for preventing said relative pivotal movement of the arm portions when the arm is in a fully extended position, each said arm, when in a fully collapsed position, having its inner and outer arm portions disposed alongside one another, with each said arm portion extending approximately vertically in close proximity to the standard.

2. The foldable clothes according to claim 1 wherein said hinge means comprises a housing formed by a pair of relative rotatable parts, said releasable locking means being housed within said housing and being operatively connected to an actuator member located externally of the housing, said locking means being movable, upon actuation of said actuator member, from a normal extended locking position wherein the inner and outer arm portions are locked against said pivotal movement, to a retracted, unlocked position wherein the inner and outer arm portions can undergo said pivotal movement.

3. The improvements according to claim 1 wherein the inner arm portion of each of said arms is pivotally connected at its inner end to a pivot means carried on the lower cross, wherein the axis of said pivot means extends approximately radially with respect to the axis of said standard, and arranged so that when the arms are fully extended, the inner arm portions thereof are disposed approximately tangentially around the outer peripheral wall of said standard.

4. The improvements according to claim 3 wherein the inner and outer arm portions of each of said arms, when in their fully extended positions, are non-collinear, and wherein the central longitudinal axis of said outer arm portion intersects the central longitudinal axis of said standard.

5. The improvements according to claim 1 wherein each of said stays has its outer end pivotally connected to a first pivot means carried by a connector bracket attached to the outer arm portion of a respective said arm, each said connector bracket being located near the inner end of said outer arm portion, are arranged and constructed so that when each of the arms is in a collapsed condition, said stay is located between its associated said inner and outer arm portions, with the stay and the inner and outer are portions being in coplanar relationship.

6. The improvements according to claim 5 wherein each of said stays is pivotally connected at its inner end to a second pivot means carried on the upper cross, wherein the axis of said second pivot means extends approximately radially with respect to the standard.

7. The improvements according to claim 2 wherein each of said housing parts comprises a cup-like disc shaped member having a central bore extending therethrough for receiving a pivot member which defines the transverse axis about which the inner and outer arm portions rotate relative to each other, said transverse axis being offset with respect to the central longitudinal axis of said arm portions.

8. The improvements according to claim 7 wherein each of said housing parts is offset by a small angle to an imaginary radial line extending away from the standard and coinciding with the central longitudinal axis of said outer arm portion.

9. The improvements according to claim 2 wherein said locking means comprises a releasable locking slide slidably housed between said pair of housing parts and being linearly slidable between a normal first locked position wherein said housing parts are locked against relative rotation with the inner and outer arm portions approximately longitudinally aligned and a retracted unlocked position which allows the inner and outer arm portions to rotate relative to other to each thereby allow each of the arms to move to its collapsed condition alongside the standard.

10. The improvements according to claim 9 wherein said housing parts are approximately of the same shape but of opposite hand.

11. The improvements according to either claim 9 wherein each said housing part has secured to its periphery an outwardly projecting spigot portion for securement to an end of a respective said arm portion.

12. The improvements according to claim 1 wherein the inner arm portion of at least one of said arms is provided with a resilient retention means for releasable snap-fitting engagement with an associated one of said stays when said at least one of said arms is fully collapsed.

13. The improvements according to claim 12 wherein said resilient retention means comprises an approximately U-shaped clip which straddles said inner arm portion with a pair of opposed legs projecting upwardly beyond the upper surface of said inner arm portion.

14. The improvements according to claim 1 wherein said lower cross or boss is fixedly secured to the standard intermediate the ends thereof.

15. The improvements according to claim 1 wherein said standard comprises a fixed lower tubular standard, an upper tubular elevating standard telescopically engageable with said lower standard, and elevating means for raising said upper standard with respect to said lower standard, wherein said lower cross or boss is fast with said upper tubular elevating standard and is raised and lowered therewith.

16. The improvements according to claim 9 wherein said locking slide is biased by a spring means housed within one of said housing parts to its said normal first locked position, the movement of the locking slide to its retracted unlocked position being resisted by said spring means.

* * * * *